United States Patent [19]

Sundquist

[11] Patent Number: 4,622,820

[45] Date of Patent: Nov. 18, 1986

[54] ABSORPTION POWER GENERATOR

[76] Inventor: Charles T. Sundquist, 1971 Sheridan Pl., Richland, Wash. 99352

[21] Appl. No.: 781,246

[22] Filed: Sep. 27, 1985

[51] Int. Cl.[4] ..... F01K 25/06

[52] U.S. Cl. ..... 60/673

[58] Field of Search ..... 60/649, 673

[56] References Cited

U.S. PATENT DOCUMENTS 4,183,218 1/1980 Eberly, Jr. ..... 60/673

4,195,485 4/1980 Brinkerhoff ..... 60/673

*Primary Examiner*—Allen M. Ostrager

[57] ABSTRACT

The absorption power generator is similar to a conventional steam power generator. High pressure vapor is produced in a vapor generator and expanded in a prime mover to produce power. Exhaust vapor from the prime mover is collapsed to liquid and pumped back into the vapor generator. The absorption power generator differs in that the temperature of the vapor generator heat source can be much lower. This is because a low boiling point liquid, such as ammonia, is vaporized instead of water. Instead of condensing the exhaust vapor from the prime mover in a condenser, the exhaust vapor is absorbed by an absorbent liquid in an absorber. For ammonia, water is the absorbent liquid. Unused heat is rejected from the process, at normal heat rejection temperatures, by a high pressure condenser, working in parallel with the prime mover.

26 Claims, 1 Drawing Figure

ABSORPTION POWER GENERATOR

SUMMARY OF INVENTION

Figure 1:
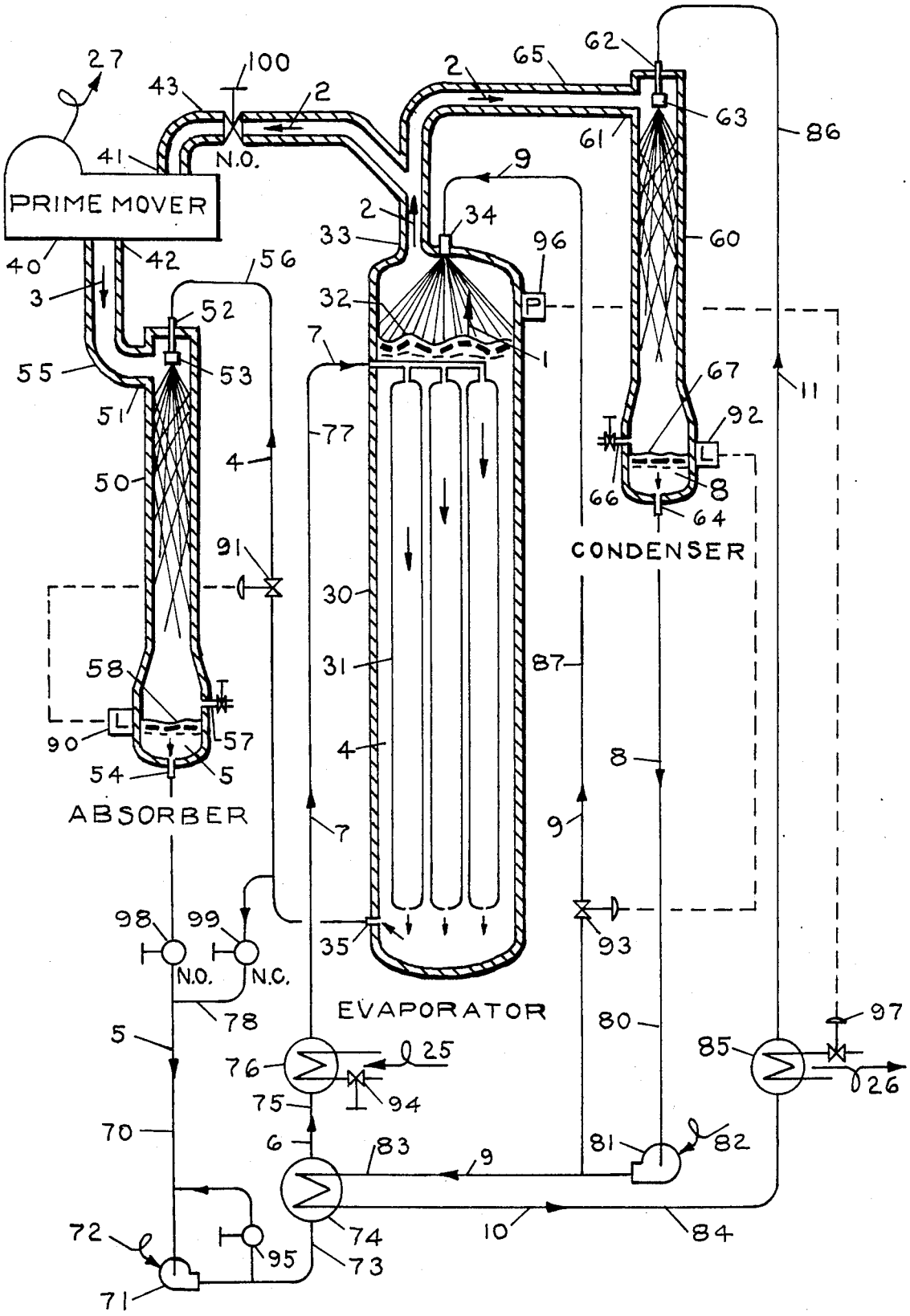

The absorption power generator is similar to a conventional steam power generator. It differs in that the temperature level of the heat source can be lower. Instead of water, a low boiling point liquid, such as ammonia, is vaporized in a high pressure vapor generator. It is expanded in a prime mover where power is extracted. Instead of condensing the low pressure vapor in a condenser, it is absorbed by an absorbent liquid in an absorber. For ammonia, water is used as the absorbent liquid. Heat is rejected from the process by a condenser, operating at high pressure.

The basic components of the absorption power generator include: an evaporator with vertical heating tubes, for generating high pressure vapor; a prime mover, for extracting power from expanding vapor; an absorber, for absorbing low pressure exhaust vapor from the prime mover; a condenser operating at high pressure, for rejecting heat from the process; a solution pumping system with a solution pump, a heat exchanger, and a solution heater; and a condensate circulating system with a condensate pump, the same heat exchanger, and a condensate cooler.

Automatic controls include two automatic liquid level control systems and one automatic pressure control system.

An object of this invention is to extract power from low temperature heat sources. Another object is to provide small stationary power plants that use waste heat from industrial processes.

FIG. 1 is a flow diagram of the absorption power generating process.

THE EVAPORATOR

The evaporator is the largest component of the absorption power generator. It produces pressurized vapor for use in the prime mover. It also provides an absorbent solution for absorbing low pressure exhaust vapor coming from the prime mover. Reflux condensate, sprayed over a boiling liquid-vapor interface in the evaporator vessel, holds down the temperature of the pressurized vapor rising from the liquid-vapor interface. This, in turn, permits the use of a low temperature heat source for driving the process.

Referring to FIG. 1, vertical tubes 31 heat weak solution 4 in the shell space of evaporator vessel 30. The shell space is the space inside evaporator vessel 30 and outside vertical tubes 31. Heating liquid 7 enters the tops of the vertical tubes and flows downward very slowly. At the bottoms of the tubes, heating liquid 7 exits into the sheel space. Heating liquid 7 then mixes into weak solution 4. Liquid-vapor interface 32 is located above the tops of vertical tubes 31. Evaporator vapor 1 separates from liquid-vapor interface 32 and rises into a spray of pumped condensate 9, coming from reflux contactor means 34.

The temperature of heating liquid 7, entering the tops of vertical tubes 31, is approximately 30° F. higher than the temperature of liquid-vapor interface 32. Proceeding downward, the liquid temperatures, inside and outside vertical tubes 31, decrease. At the same time these temperatures approach each other. At the bottoms of the tubes, the inside and outside temperatures are very close and approximately 100° F. cooler than the temperature of liquid-vapor interface 32.

In the shell space, weak solution 4 is in a highly agitated condition. The fluid particles are not, however, in pure random motion. Instead, under the force of gravity, they organize themselves into a systematic pattern of motion. A steady upwardly directed heat flux establishes itself in the shell space. Tiny rapidly rotating heat transfer cells form on the outsides of vertical tubes 31. These primary cells induce secondary, tertiary, etc. rotating cells which fill the entire shell space up to liquid-vapor interface 32. Lower cells pass heat upward to warmer cells above so that all of the heat transferred through the walls of vertical tubes 31 is transferred upward through liquid-vapor interface 32. In order for this process to sustain itself, it is necessary that vapor be removed from the vapor space above liquid-vapor interface 32 as rapidly as it is formed.

The inside of vertical tubes 31 are also filled with rapdily rotating cells transferring heat through the tube walls. In this region, cool particles of liquid are passed downward from cell to cell. It is important that vertical tubes 31 be of large enough diameter for this phenomenon to sustain itself. Two inch schedule 10 pipe has worked well in this kind of evaporator. Tube diameters too small will result in the phenomenon being unable to be a dynamic steady state condition where the top of the evaporator stays warm and the bottom stays cold.

The coolness of heating liquid 7, leaving the bottoms of vertical tubes 31, is important to the energy economy of the process. It results in a large rate of heat transfer in the evaporator while using very little pumping power. Also, the pressure drop available to the prime mover depends directly on this coolness.

Heating liquid 7 is a solution of a low boiling point liquid and a liquid absorbent. An example is ammonia absorbed in water. Heating liquid 7 is the source of evaporator vapor 1 and weak solution 4. Weak solution 4 exits from the lower part of evaporator vessel 30 through weak solution outlet 35.

Pumped condensate 9 is mixed intimately with evaporator vapor 1 by reflux contactor means 34, forming rectified vapor 2. Rectified vapor 2 exits from the top of evaporator vessel 30 through vapor outlet 33.

Reflux contactor means 34 can take different forms. It could be a spray nozzle. It could be a tray with sprinkling holes in the bottom. It could be a simple opening in the top of evaporator vessel 30, spilling pumped condenstate 9 into the vapor space. The preferred form is a spray nozzle, as shown in FIG. 1. The spray nozzle promotes faster and more widely distributed mixing than other forms of reflux contactor 34.

THE PRIME MOVER

Prime mover 40 can be an expansion engine similar to those used for the liquifaction of gases. It could be a reciprocating type similar to the stationary steam used at the turn of the century. It could be a modern turbine expander. It could also be a reciprocating direct acting pump. Various devices which extract mechanical or electrical power from expanding gases or vapors can be used for prime mover 40.

Referring to FIG. 1, rectified vapor 2, at high pressure, flows from vapor outlet 33 in evaporator vessel 30 through power vapor conduit 43 to high pressure inlet 41 in prime mover 40. Exhaust vapor 3, at low pressure, exits from prime mover 40 through low pressure outlet 42. Power 27 is extracted from expanding rectified vapor 2 as it passes through prime mover 40.

THE ABSORBER

The absorber is similar to the absorber used in absorption refrigeration except that cooling is not provided to the absorber. Instead, heat of absorption is retained in the rich solution for subsequent use in the process. A simple closed vessel with two inlets, one outlet, and a solution contactor means could be used. The purpose of the solution contactor means is to provide intimate contact between weak solution 4 and exhaust vapor 3. The solution contactor means can take several forms. It can be a spray nozzle. It can be a tray with sprinkling holes in the bottom. It can be a liquid surface exposed to vapor.

The absorber vessel should be designed like a simple vacuum ejector with a low pressure inlet, a manifold, a spray nozzle, and a diffuser. The outlet of the diffuser should be directed downward into a sump with a vapor-liquid interface. The ejector should operate at a very low pressure rise, as measured from the low pressure inlet to the vapor-liquid interface. A pressure rise of approximately one inch water gage is adequate. FIG. 1 shows a preferred arrangement of the absorber.

Low pressure exhaust vapor 3 flows from low pressure vapor outlet 42, of prime mover 40, through exhaust vapor conduit 55 into exhaust vapor inlet 51, of absorber vessel 50. Weak solution 4 flows into absorber vessel 50 through weak solution inlet 52. Inside absorber vessel 50, weak solution 4 is mixed intimately and rapidly with exhaust vapor 3 by solution contactor means 53. In FIG. 1, solution contactor means 53 is shown as a spray nozzle. Weak solution 4 absorbs exhaust vapor 3 to become strong solution 5, which then collects in the bottom of absorber vessel 50. Absorber vapor-liquid interface 58 is the liquid surface where strong solution 5 is in contact with the mixture of exhaust vapor 3 and solution droplets, above. Non-condensible gases, entering the top of absorber vessel 50 are pushed downward by the falling droplets and are trapped just above absorber vapor-liquid interface 58. Valved absorber vent opening 57, located just above the interface, can be used to vent non-condensible gases from the process. Strong solution 5 exits from the bottom of absorber vessel 50 through strong solution outlet 54.

THE CONDENSER

The condenser should be designed in a manner similar to the absorber. However, there are some differences that must be considered. The condenser operates on the high pressure side of the prime mover instead of the low pressure side. Also, vapor is condensed rather than being absorbed.

Referring to FIG. 1, rectified vapor 2 flows from vapor outlet 33, in evaporator vessel 30, through rectifier conduit 65 to rectified vapor inlet 61, in condenser vessel 60. It is not necessary that rectifier conduit 65 be connected to the same vapor outlet on evaporator vessel 30 as power vapor conduit 43. Separate vapor outlets could be provided.

Cool condensate 11 flows into condenser vessel 60 through cool condensate inlet 62. Inside condenser vessel 60, cool condensate 11 is mixed intimately with rectified vapor 2 by condensate contactor means 63. In FIG. 1, condensate contactor means 63 is shown as a spray nozzle. This is the preferred means. There are other possible condensate contactor means, just as with the absorber.

Cool condensate 11 condenses rectified vapor 2 by direct contact. Hot condensate 8 then collects in the bottom of condenser vessel 60. Condenser vapor liquid interface 67 is the liquid surface where hot condensate 8 is in contact with the mixture of rectified vapor 2 and condensate droplets, above. Non-condensible gases, entering the top of condenser vessel 60, are pushed downward by the falling droplets of condensate and are trapped just above condenser vapor-liquid interface 67. Valved condenser vent opening 66, located just above condenser vapor-liquid interface 67, can be used to vent non-condensible gases from the process. hot condensate 8 exits from the bottom of condenser vessel 60 through hot condensate outlet 64.

The high pressure in the condenser functions to raise the temperature of the condensate so that heat can be more easily rejected from the process. Rejected heat 26 is removed by means of condensate cooler 85. With rectified vapor 2 being at a high temperature because of the high pressure, cool condensate 11, coming from condensate cooler 85, can be at a comparatively high temperature. Therefore, rejected heat 26 can be at a relatively high temperature.

The condenser also functions to provide reflux condensate use to rectify and hold down the temperature of evaporator vapor 1. This leads to a lower temperature requirement for heating liquid 7, being supplied to the tops of vertical tubes 31. In turn, the temperature of input heat 25, being supplied to solution heater 76, can be lower.

THE SOLUTION PUMPING SYSTEM

The absorption power generator includes a solution pumping system which pumps strong solution from the absorber to the shell space of the evaporator. Referring to FIG. 1, strong solution 5 flows from strong solution outlet 54 through solution suction conduit 70 through solution pump 71 through solution discharge conduit 73 to heat exchanger 74. From heat exchanger 74, warm solution 6 flows through warm solution conduit 75 to solution heater 76. From solution heater 76, heating liquid 7 flows through heating conduit 77 to the tops of vertical tubes 31. In solution heater 76, input heat 25 is added to the strong solution to drive the process.

The evaporator production capacity is controlled by controlling the rate at which input heat 25 is supplied to solution heater 76 and also by the flow rate of heating liquid 7. To control the evaporator production capacity, solution heater 76 should include input heat control means 94. In FIG. 1, input heat control means 94 is shown as a flow control valve in a heating fluid circuit through a heating coil in solution heater 76. Other kinds of input heat control means are also possible.

The solution pumping system should include solution flow control means 95 for controlling the flow rate of heating liquid 7. In FIG. 1, solution flow control means 95 is shown as a flow control valve in a recirculation conduit at solution pump 71. Other solution flow control means are also possible.

THE CONDENSATE CIRCULATING SYSTEM

The absorption power generator includes a circulating system for circulating condensate through the process. Hot condensate 8, from hot condensate outlet 64, flows through condensate suction conduit 80 to condensate pump 81. Pumped condensate 9 flows from condensate pump 81 through pumped condensate conduit 83 to heat exchanger 74. Warm condensate 10 flows from heat exchanger 74 through warm condensate conduit 84 to condensate cooler 85. Cool condensate 11 flows from condensate cooler 85 through cool condensate conduit 86 to cool condensate inlet 62.

Condensate cooler 85 should include cooling control means 97 for controlling the rate at which rejectd heat 26 is withdrawn from the process. In FIG. 1, cooling control means 97 is shown as a flow control valve in a cooling fluid circuit through a cooling coil in condensate cooler 85. Other cooling control means are also possible.

The condensate circulating system supplies reflux condensate to the evaporator. Pumped condensate 9, from condensate pump 81, flows through reflux conduit 87 to reflux contactor means 34.

AUTOMATIC CONTROLS

The liquid level in the absorber should be controlled automatically. In FIG. 1, absorber liquid level controller 90 senses the level of absorber vapor-liquid interface 58 and operates weak solution control valve 91, in weak solution conduit 56, to control the liquid level.

The liquid level in the condenser should be controlled automatically. In FIG. 1, condenser liquid level controller 92 senses the level of condenser vapor-liquid interface 67 and operates reflux control valve 93, in reflux conduit 87, to control the liquid level.

The pressure level in the evaporator should be controlled automatically. In FIG. 1, pressure controller 96 senses the pressure in evaporator vessel 30 and operates cooling control means 97, to control the temperature of cool condensate 11 and, indirectly, the pressure in the evaporator and condenser.

A START UP PROCEDURE

Different procedures can be used to start up the absorption power generator. The following is one such procedure;

Rich solution valve 98, in solution suction conduit 70, is closed. Start-up valve 99, in start-up conduit 78, is opened. Power valve 100, in power vapor conduit 43, is closed. Solution pump 71 is started. Input heat 25 is started into solution heater 76. Heating then commences in the evaporator, proceeding very slowly from the top down.

When the temperature in the vapor space of the evaporator reaches operating level, condensate pump 81 is started. Evaporator vapor 1 flows from the evaporator into the condenser where it is condensed by the flow of cool condensate 11. Condenser liquid level controller 92 senses an increase in the level of condenser vapor-liquid interface 67 and operates reflux control valve 93 to allow pumped condensate 9 to begin flowing into reflux contactor means 34.

When the pressure of rectified vapor 2 reaches operating level, pressure controller 96 operates cooling control means 97 to commense removing rejected heat 26 from the process. Pressure controller 96 then controls the pressure level of rectified vapor 2 by operating cooling control means 97.

As the process continues, the temperatures in the lower part of the evaporator decrease until their operating levels are reached. These levels are well below start up temperature levels.

When steady state operating temperatures are reached in the evaporator and condenser, the prime mover and absorber are activated. Rich solution valve 98 is opened. Start-up valve 99 is closed. Power valve 100 is then gradually opened. Rectified vapor 2 flows into prime mover 40. Exhaust vapor 3 flows into absorber vessel 50 where it is absorbed by weak solution 4, now entering through weak solution inlet 52. The pressure in the absorber stabilizes at a low pressure level. Power 27 is then extracted from rectified vapor 2 as it expands in prime mover 40.

AN AQUA-AMMONIA EXAMPLE

The following is an engineering estimate of the performance of an example aqua-ammonia absorption power generator. The results presented are based on a flow of one pound per hour of rectified vapor 2 through the prime mover. The following assumptions were made:

zero heat transfer through vessel and pipe walls
rectified vapor 2 is 100% ammonia
prime mover engine efficiency=80%
pump efficiency=60%

The kind of prime mover 40 considered in this estimate is an expansion engine like those used in the cryogenic liquifaction of gases. These engines achieve engine efficiencies of 85% or more. Following is an estimated process heat balance:

| | |
|---|---|
| input heat 25 = | +461 BTUH |
| solution pump heat 72 = | +12 BTUH |
| condensate pump heat 82 = | +10 BTUH |
| power 27 = | −86 BTUH |
| rejected heat 26 = | −397 BTUH |
| total = | 0 |

Specific data used on the fluid conditions are listed in the following table. Data on the properties of aqua-ammonia solutions was taken from the chart "Properties of Aqua-ammonia", Refrigeration Engineering, vol. 58, no. 10, October, 1950. Fluid designations are taken from FIG. 1. The quantity x is the ammonia fraction in the fluid. The quantity h is the enthalpy of the fluid in BTU/lb. The quantity p is the absolute pressure of the fluid in psia. The quantity m is the flow of the fluid in pounds per hour.

| fluid | t | x | h (BTU/lb) | p (psia) | m (PPH) |
|---|---|---|---|---|---|
| 1 | 100 F. | 1.00 | +556 | 70 | 1 |
| 2 | 100 F. | 1.00 | +556 | 212 | 3.03 |
| 3 | −10 F. | 1.00 | +470 | 24 | 1 |
| 4 | −30 F. | .500 | −173 | — | 8.66 |
| 5 | 32 F. | .552 | −105 | — | 9.66 |
| 6 | 90 F. | .552 | −45 | — | 9.66 |
| 7 | 130 F. | .552 | +3 | — | 9.66 |
| 8 | 100 F. | 1.00 | +78 | 212 | 35.4 |
| 9 | 100 F. | 1.00 | +78 | — | 2.03 |
| 10 | 85 F. | 1.00 | +61 | — | 33.4 |
| 11 | 75 F. | 1.00 | +49 | — | 33.4 |

The pressure of evaporator vapor 1 is a partial pressure. The other 142 psi required to balance the vapor pressure of hot condensate 8, in the condenser, is provided by 2.03 PPH of pumped condensate 9 supplied through reflux contactor means 34.

THE HEAT EXCHANGER

Heat exchanger 7 is not necessary for the absorption power generator to work. The process will work but input heat 25 and rejected heat 26 will each be 100% or more greater. The preferred embodiment of the invention is with heat exchanger 74, as shown in FIG. 1.

The inventor claims:

1. An absorption power generator including the following: an evaporator including an evaporator vessel, a vertical tube inside said evaporator vessel, weak solution in the shell space of said evaporator vessel, a liquid-vapor interface in said evaporator vessel, a vapor outlet from said evaporator vessel, a reflux contactor means, a weak solution outlet from said evaporator vessel, heating liquid entering the top of said vertical tube, heating liquid flowing downward and exiting from the bottom of said evaporator tube, heating liquid mixing into said weak solution, weak solution exiting through said weak solution outlet, evaporator vapor separating from said liquid-vapor interface, pumped condensate being introduced into evaporator vapor by said reflux contactor means, pumped condensate being evaporated by evaporator vapor and the resulting mixture becoming rectified vapor, rectified vapor exiting from said evaporator vessel through said vapor outlet; a prime mover including a high pressure inlet, a low pressure outlet, rectified vapor entering said high pressure inlet, power being extracted from rectified vapor in said prime mover, exhaust vapor exiting through said low pressure outlet; a power vapor conduit connecting a vapor outlet in said evaporator vessel to said high pressure inlet, rectified vapor flowing from said evaporator vessel through said power vapor conduit to said prime mover; an absorber including an absorber vessel, an exhaust vapor inlet, a weak solution inlet, a solution contactor means, a strong solution outlet, exhaust vapor entering said exhaust vapor inlet, weak solution entering said weak solution inlet, weak solution being introduced into exhaust vapor by said solution contactor means, weak solution absorbing exhaust vapor and becoming strong solution, strong solution exiting through said strong solution outlet; an exhaust vapor conduit connecting said low pressure outlet to said exhaust vapor inlet, exhaust vapor flowing from said prime mover through said exhaust vapor conduit to said absorber vessel; a weak solution conduit connecting said weak solution outlet to said weak solution inlet, weak solution flowing from said evaporator vessel through said weak solution conduit to said absorber vessel; a condenser including a condenser vessel, a rectified vapor inlet, a cool condensate inlet, a condensate contactor means, a hot condensate outlet, rectified vapor entering said rectified vapor inlet, cool condensate entering said cool condensate inlet, cool condensate being introduced into rectified vapor by said condensate contactor means, cool condensate condensing rectified vapor in said condenser vessel, hot condensate collecting inside said condenser vessel, hot condensate exiting through said hot condensate outlet; a rectifier conduit connecting a vapor outlet in said evaporator vessel to said rectified vapor inlet, rectified vapor flowing from said evaporator vessel through said rectifier conduit to said condenser vessel; a solution pumping system including a solution suction conduit connecting said strong solution outlet to the inlet of a solution pump, a solution discharge conduit connecting the outlet of said solution pump to the solution inlet of a heat exchanger, a warm solution conduit connecting the solution outlet of said heat exchanger to the solution inlet of a solution heater, a heating conduit connecting the solution outlet of said solution heater to the top of said vertical tube, stronge solution flowing from said absorber vessel through said solution suction conduit through said solution pump through said solution discharge conduit into said heat exchanger, warm solution flowing from said heat exchanger through said warm solution conduit into said solution heater, heating liquid flowing from said solution heater through said heating conduit to the top of said vertical tube; input heat entering said solution heater; a condensate circulating system including a condensate suction conduit connecting said hot condensate outlet to the inlet of a condensate pump, a pumped condensate conduit connecting the outlet of said condensate pump to the condensate inlet of said heat exchanger, a warm condensate conduit connecting the condensate outlet of said heat exchanger to the condensate inlet of a condensate cooler, a cool condensate conduit connecting the condensate outlet of said condensate cooler to said cool condensate inlet, hot condensate flowing from said condenser vessel through said condensate suction conduit into said condensate pump, pumped condensate flowing from said condensate pump through said pumped condensate conduit into said heat exchanger, warm condensate flowing from said heat exchanger through said warm condensate conduit into said condensate cooler, cool condensate flowing from said condensate cooler through said cool condensate conduit to said condenser vessel; rejected heat being removed from said condensate cooler; a reflux conduit connecting the outlet of said condensate pump to said reflux contactor means, pumped condensate flowing from said condensate pump through said reflux conduit to said reflux contactor means.

2. An absorption power generator including the following: an evaporator including an evaporator vessel, a vertical tube inside said evaporator vessel, weak solution in the shell space of said evaporator vessel, a liquid-vapor interface in said evaporator vessel, a vapor outlet from said evaporator vessel, a reflux contactor means, a weak solution outlet from said evaporator vessel, heating liquid entering the top of said vertical tube, heating liquid flowing downward and exiting from the bottom of said evaporator tube, heating liquid mixing into said weak solution, weak solution exiting through said weak solution outlet, evaporator vapor separating from said liquid-vapor interface, pumped condensate being introduced into evaporator vapor by said reflux contactor means, pumped condensate being evaporated by evaporator vapor and the resulting mixture becoming rectified vapor, rectified vapor exiting from said evaporator vessel through said vapor outlet; a prime mover including a high pressure inlet, a low pressure outlet, rectified vapor entering said high pressure inlet, power being extracted from rectified vapor in said prime mover, exhaust vapor exiting through said low pressure outlet; a power vapor conduit connecting a vapor outlet in said evaporator vessel to said high pressure inlet, rectified vapor flowing from said evaporator vessel through said power vapor conduit to said prime mover; an absorber including an absorber vessel, an exhaust vapor inlet, a weak solution inlet, a solution contactor means, a strong solution outlet, exhaust vapor entering said exhaust vapor inlet, weak solution entering said weak solution inlet, weak solution being introduced into exhaust vapor by said solution contactor means, weak solution absorbing exhaust vapor and becoming strong solution, strong solution exiting through said strong solution outlet; an exhaust vapor conduit connecting said low pressure outlet to said exhaust vapor inlet, exhaust vapor flowing from said prime mover through said exhaust vapor conduit to said absorber vessel; a weak solution conduit connecting said weak solution outlet to said weak solution inlet, weak solution flowing from said evaporator vessel through said weak solution conduit to said absorber vessel; a condenser including a condenser vessel, a rectified vapor inlet, a cool condensate inlet, a condensate contactor means, a hot condensate outlet, rectified vapor entering said rectified vapor inlet, cool condensate entering said cool condensate inlet, cool condensate being introduced into rectified vapor by said condensate contactor means, cool condensate condensing rectified vapor in said condenser vessel, hot condensate collecting inside said condenser vessel, hot condensate exiting through said hot condensate outlet; a rectifier conduit connecting a vapor outlet in said evaporator vessel to said rectified vapor inlet, rectified vapor flowing from said evaporator vessel through said rectifier conduit to said condenser vessel; a solution pumping system including a solution suction conduit connecting said strong solution outlet to the inlet of a solution pump, a solution discharge conduit connecting the outlet of said solution pump to the solution inlet of a solution heater, a heating conduit connecting the solution outlet of said solution heater to the top of said vertical tube, strong solution flowing from said absorber vessel through said solution suction conduit through said solution pump through said discharge conduit into said solution heater, heating liquid flowing from said solution heater through said heating conduit to the top of said vertical tube; input heat entering said solution heater; a condensate circulating system including a condensate suction conduit connecting said hot condensate outlet to the inlet of a condensate pump, a pumped condensate conduit connecting the outlet of said condensate pump to the condensate inlet of a condensate cooler, a cool condensate conduit connecting the condensate outlet of said condensate to said cool condensate inlet, hot condensate flowing from said condenser vessel through said condensate suction conduit into said condensate pump, pumped condensate flowing from said condensate pump through said pumped condensate conduit into said condensate cooler, cool condensate flowing from said condensate cooler through said cool condensate conduit to said condenser vessel; rejected heat being removed from said condensate cooler; a reflux conduit connecting the outlet of said condensate pump to said reflux contactor means, pumped condensate flowing from said condensate pump through said reflux conduit to said reflux contactor means.

3. An absorption power generator as in claim 1, said reflux contactor means being a spray nozzle.

4. An absorption power generator as in claim 1, said solution contactor means being a spray nozzle.

5. An absorption power generator as in claim 1, said condensate contactor means being a spray nozzle.

6. An absorption power generator as in claim 1 including a valved absorber vent opening, in said absorber vessel, venting non-condensible gases from said absorber vessel.

7. An absorption power generator as in claim 1 including a valved condenser vent opening, in said condenser vessel, venting non-condensible gases from said condenser vessel.

8. An absorption power generator as in claim 1 including an absorber liquid level controller sensing the level of an absorber vapor-liquid interface, in said absorber vessel, and controlling the level of said absorber vapor-liquid interface by means of a weak solution control valve in said weak solution conduit.

9. An absorption power generator as in claim 1 including a condenser liquid level controller sensing the level of a condenser vapor-liquid interface, in said condenser vessel, and controlling the level of said condenser vapor-liquid interface by means of a reflux control valve in said reflux conduit.

10. An absorption power generator as in claim 1 including an input heat control means for controlling the rate at which said input heat is supplied to said solution heater.

11. An absorption power generator as in claim 1 including a solution flow control means for controlling the flow rate of heating liquid entering the top of said vertical tube.

12. An absorption power generator as in claim 1 including a cooling control means for controlling the rate at which said rejected heat is withdrawn from said condensate cooler.

13. An absorption power generator as in claim 1 including a pressure controller sensing the pressure of rectified vapor and operating a cooling control means to control the rate at which said rejected heat is withdrawn from said condensate cooler and to indirectly control the pressure of rectified vapor.

14. An absorption power generator as in claim 1 including a start-up valve in a start-up conduit connecting said weak solution outlet to the inlet of said solution pump, weak solution flowing from said evaporator vessel through said start-up conduit to the inlet of said solution pump.

15. An absorption power generator as in claim 2, said reflux contactor means being a spray nozzle.

16. An absorption power generator as in claim 2, said solution contactor means being a spray nozzle.

17. An absorption power generator as in claim 2, said condensate contactor means being a spray nozzle.

18. An absorption power generator as in claim 2 including a valved absorber vent opening, in said absorber vessel, venting non-condensible gases from said absorber vessel.

19. An absorption power generator as in claim 2 including a valved condenser vent opening, in said condenser vessel, venting non-condensible gases from said condenser vessel.

20. An absorption power generator as in claim 2 including an absorber liquid level controller sensing the level of an absorber vapor-liquid interface, in said absorber vessel, and controlling the level of said absorber vapor-liquid interface by means of a weak solution control valve in said weak solution conduit.

21. An absorption power generator as in claim 2 including a condenser liquid level controller sensing the level of condenser vapor-liquid interface, in said condenser vessel, and controlling the level of said condenser vapor-liquid interface by means of a reflux control valve in said reflux conduit.

22. An absorption power generator as in claim 2 including an input heat control means for controlling the rate at which said input heat is supplied to said solution heater.

23. An absorption power generator as in claim 2 including a solution flow control means for controlling the flow rate of heating liquid entering the top of said vertical tube.

24. An absorption power generator as in claim 2 including a cooling control means for controlling the rate at which said rejected heat is withdrawn from said condensate cooler.

25. An absorption power generator as in claim 2 including a pressure controller sensing the pressure of rectified vapor and operating a cooling control means to control the rate at which said rejected heat is withdrawn from said condensate cooler and to indirectly control the pressure of rectified vapor.

26. An absorption power generator as in claim 2 including a start-up valve in a start-up conduit connecting said weak solution outlet to the inlet of said solution pump, weak solution flowing from said evaporator vessel through said start-up conduit to the inlet of said solution pump.

* * * * *